United States Patent [19]

Honrath

[11] Patent Number: 4,459,947

[45] Date of Patent: Jul. 17, 1984

[54] AIR-COOLED MULTICYLINDER INTERNAL COMBUSTION ENGINE HAVING OVERHEAD CAMSHAFT

[75] Inventor: Kurt Honrath, Rösrath, Fed. Rep. of Germany

[73] Assignee: Klöckner-Humboldt-Deutz Aktiengesellschaft, Cologne, Fed. Rep. of Germany

[21] Appl. No.: 405,387

[22] Filed: Aug. 5, 1982

[30] Foreign Application Priority Data

Aug. 6, 1981 [DE] Fed. Rep. of Germany ..... 3131128

[51] Int. Cl.³ ..... F01L 1/46

[52] U.S. Cl. ..... 123/90.27; 123/193 H

[58] Field of Search ..... 123/90.27, 193 H, 52 M, 123/90.31

[56] References Cited

U.S. PATENT DOCUMENTS 3,139,870 7/1964 Sampietro ..... 123/90.27 X
3,144,013 8/1964 Péras ..... 123/90.27 X

FOREIGN PATENT DOCUMENTS 1293787 4/1969 Fed. Rep. of Germany ... 123/90.27
853700 3/1940 France ..... 123/52 M

*Primary Examiner*—William R. Cline
*Assistant Examiner*—Peggy A. Neils
*Attorney, Agent, or Firm*—Becker & Becker, Inc.

[57] ABSTRACT

An air-cooled internal combustion engine with individual cylinder heads. In order, with such an engine, to be able to use a single overhead camshaft for all cylinders located in-line, it is proposed according to the present invention to fasten the camshaft on the intake pipe, and to extend the rocker arms laterally beyond the cylinder head in such a manner so that the rocker arms can cooperate with the cams of the camshaft.

9 Claims, 3 Drawing Figures

AIR-COOLED MULTICYLINDER INTERNAL COMBUSTION ENGINE HAVING OVERHEAD CAMSHAFT

The present invention relates to an air-cooled multicylinder internal combustion engine having an overhead camshaft, individual cylinder heads, and an intake pipe or manifold flanged to the cylinder heads; individual branch lines or connecting passages branch off or lead from this intake pipe to each air inlet passage in each cylinder head.

German Offenlegungsschrift No. 25 02 058 discloses an air cooled multicylinder internal combustion engine having an overhead camshaft, with the camshaft housing being arranged above the cylinder heads and being fastened on any two of the highest cylinder heads; a free spacing is left between the remaining cylinder heads and the camshaft housing. This is necessary because with air cooled multicylinder internal combustion engines having individual cylinder heads and individual cylinders, the structural heights of the individual cylinder head/cylinder units are different relative to each other. Although these differences only amount to a few millimeters, they are too great to allow the mounting or journalling of a camshaft thereon. The arrangement according to the cited German Offenlegungsschrift consequently requires a costly assembly, since when mounting the camshaft housing, the free spacing between the cylinder heads and the housing must first be determined before the camshaft housing can be finally assembled after selection of the suitable spacers. This procedure represents much too great a structural cost.

It is an object of the present invention to improve the aforementioned overhead camshaft arrangement in such a way that a single overhead camshaft can be used for all of the cylinders arranged in-line, and to do so in an economical manner.

This object, and other objects and advantages of the present invention, will appear more clearly from the following specification in connection with the accompanying drawings, in which.

Figure 1:
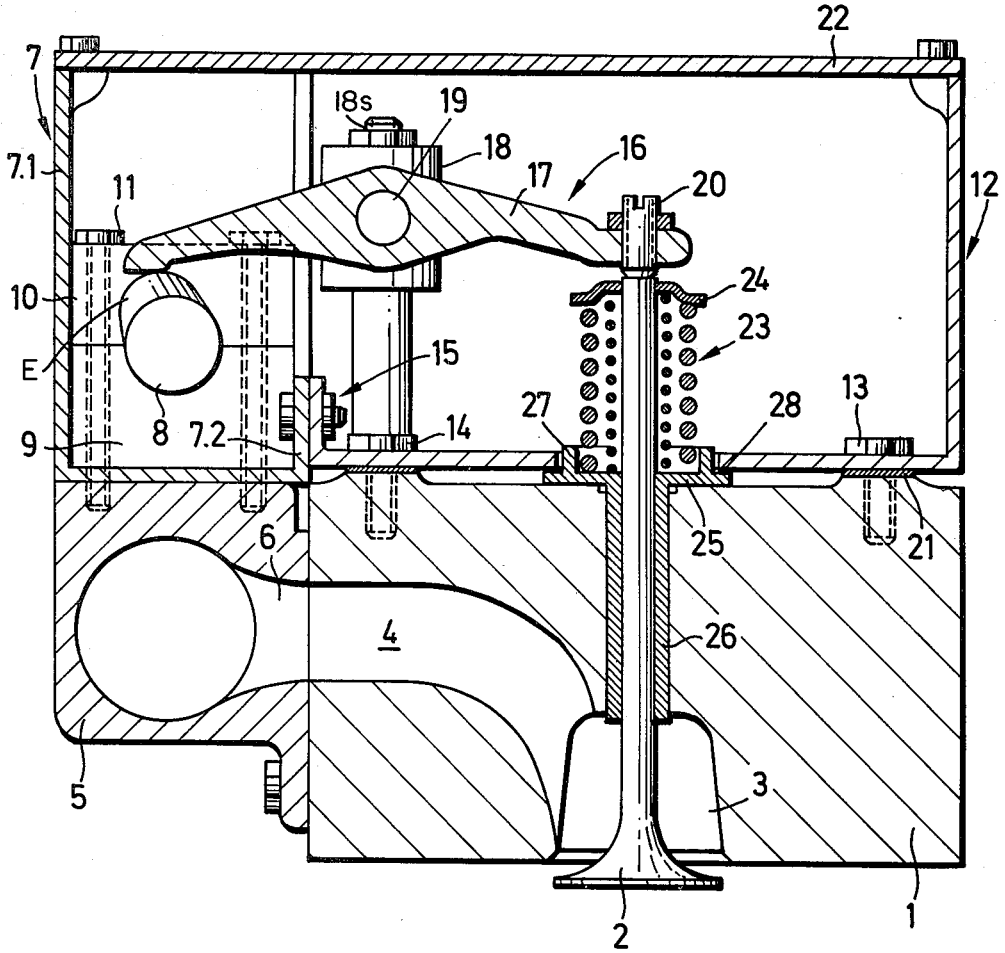
FIG. 1 is a schematic cross sectional view through one inventive embodiment of an individual air-cooled cylinder head having an intake pipe or manifold, and an overhead camshaft mounted thereon.
Figure 1A:
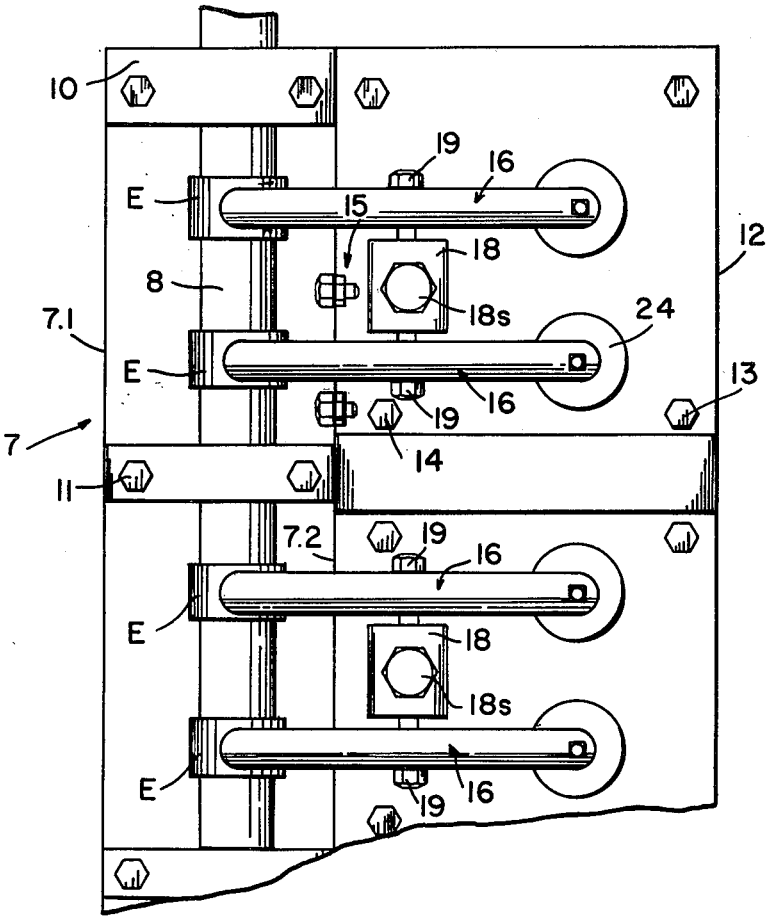
FIG. 1A is a fragmentary plan view of the foregoing embodiment.

The internal combustion engine of the present invention is characterized primarily in that the intake pipe is the carrier and mounting element for the camshaft, with actuation of the valves being effected by suitable transfer elements.

The inventive arrangement has the advantage that the camshaft, or the camshaft housing, is disposed directly above the intake pipe. The intake pipe itself must be attached in such a way that no alignment is necessary, or that such alignment can be readily accomplished, since a connection is necessary to each cylinder head. The camshaft can be arranged to the side, above, or below the intake pipe, depending upon the alignment of the intake pipe. A further advantage of the present invention is that as a result of mounting the camshaft on the intake pipe, the structural dimensions of the internal combustion engine are practically not affected at all.

The actuation of the valves can be effected via rocker arms which are in direct operative connection with the cams of the camshaft.

According to a further development of the present invention, it is proposed to accommodate the camshaft and the valve actuating devices, such as rocker arm together with the mounting, in a U-shaped housing which is mounted on the intake pipe and is common for all cylinder heads arranged in-line. This, however, is time consuming when a cylinder has to be repaired.

Consequently, it is proposed that the housings for the camshaft and for the valve actuating devices can also be separate for each cylinder. On the one hand this has the advantage that now one cylinder or cylinder head can be removed without also having to remove the camshaft housing or the housing of the adjoining valve actuating devices. On the other hand, only one type of housing has to be kept available for the valve actuating device, independently of the number of cylinders.

It is within the scope of the present invention to provide a common cover or top for all housings, or separate covers can be provided for the camshaft housing and for the remaining housings. In the latter situation, it is, however, then necessary to respectively provide a seal between the housings.

According to a further development of the present invention, the camshaft housing is advantageously connected with the intake pipe via the fastening screws for the camshaft bearing or mounting, or for the bearing cover in the event a bearing section is cast integrally with the housing. The camshaft can, however, also be mounted directly on the intake pipe, in which case the pipe takes over the housing function.

In order to be able to fasten all housings at the same height, especially when utilizing a common cover and separate housings, spacers or different thicknesses may be placed between the cylinder head and the housings for the valve actuating device.

According to an especially simple sealing of the valve guide at the bottom of the housing for the valve actuating devices, openings may be provided in the bottom of the housing of the valve actuating device so that the upper valve disc can pass through, with the valve guide comprising two coaxially arranged, circular cylindrical sleeves, including a valve guide and a collet or collar, which have different diameters and are connected with each other by a horizontal engagement and sealing disc. The advantage of this arrangement is that the housing can be removed without having to remove or disassemble the valve springs.

It is also within the scope of the present invention to provide no separate housing for the camshaft and for the valve actuating devices, but rather to respectively cast such housing means integrally with the intake pipe or with the cylinder head. In this case, both of the housings must be sealed-off with respect to each other. Thhe more costly valve guide can then be eliminated, since a sealing-off is no longer necessary at this location.

Figure 2:
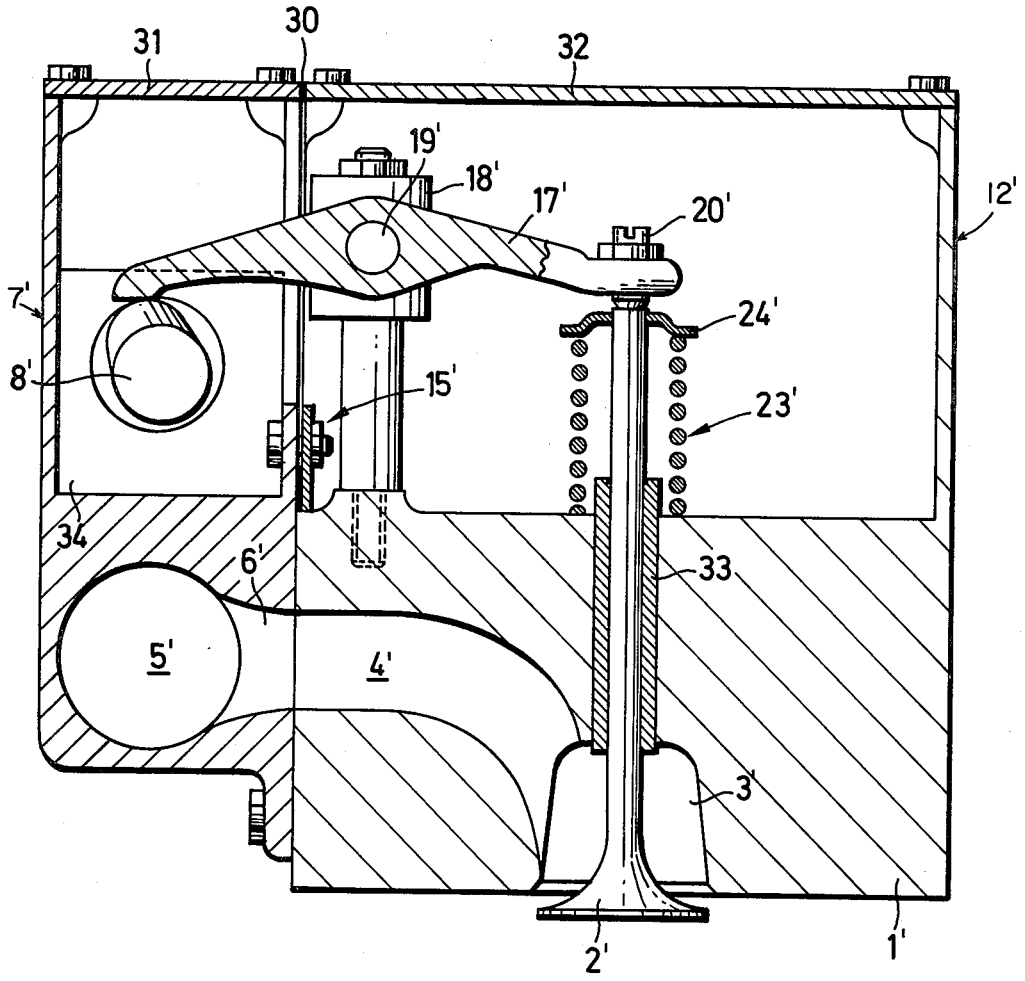
FIG. 2 is a schematic cross sectional view through another inventive embodiment of an individual air-cooled cylinder head having an intake pipe or manifold, and an overhead camshaft mounted thereon.

Referring now to the drawings in detail, in both of the FIGS. 1 and 2 only those elements necessary for understanding the present invention are schematically illustrated.

FIG. 1 shows an individual cylinder head 1 of an air-cooled internal combustion engine, which is not shown in further detail. The cylinder head includes, among other features, a valve 2, a valve chamber 3, and an air inlet passage 4.

An intake pipe or manifold 5 is connected to the side of the cylinder head 1 at the passage 4; a connecting passage 6 branches off from the intake pipe 5 into the air inlet passage 4.

A housing 7, which contains the camshaft 8 having an extension E over each of the cylinder heads 1 for receiving a valve actuating device 16 therewith, is mounted or seated on the intake pipe 5. The housing 7 has a U-shaped cross section, with the outer leg 7.1 thereof being considerably higher than the inner leg 7.2. The housing 7 is closed on its two not visible end faces, and the camshaft is driven via a chain inside the housing 7, or via a toothed belt externally of the housing 7, by the crankshaft or other suitable shaft of the internal combustion engine.

The camshaft 8 itself is mounted or journalled in split bearing sections 9 and 10. The fastening screws 11 for the bearing sections 9 and 10 are secured or fastened in the intake pipe 5 so that at the same time the housing 7 is held on the intake pipe 5 by these screws 11.

A further housing 12 is mounted on the side of the housing 7, and on the cylinder head 1. The housing 12 is fastened to the cylinder head 1 via screws 13, 14, and to the housing via a nut and bolt connection 15. The valve actuating device 16 is accommodated in the housing 12; this valve actuating device comprises two rocker arms 17, the rocker arm bracket 18 (which is fastened to the bottom of the housings via screw 18s), the rocker arm shaft 19, and the valve adjustment screws 20. The housing 12 is arranged at the same height as the housing 7 by suitable spacers 21 when all of the housings are to be closed by a common cover or top 22. This height equalization can be eliminated if separate covers or tops are used.

Each valve is actuated by the camshaft 8 via the rocker arm 17 against the force of the valve spring 23. This valve spring is clamped or placed between the upper valve disc 24 and the lower valve disc 25, which forms a unit with the valve guide 26. The valve guide 26 passes through the bottom of the housing 12. A collet or collar 27 which surrounds the valve spring 23 is arranged on the lower valve disc 25. The height of the collet 27 is such that it projects positively into the space enclosed by the housing 12. A seal 28 is provided between the valve disc 25 and the bottom of the housing 12; the thickness of the seal 28 corresponds to the thickness of the spacer 21 which is being used. Consequently, the inner space of the housing is sealed oiltight.

To exchange or replace the cylinder head 1, the cover 22 is first removed; thereupon, the housing 12 is loosened. The housing 12 can then be lifted together with the rocker arms 17 and the fastening means thereof from the cylinder head. The cylinder head 1 is then unscrewed from the intake pipe 5, and can be lifted from the cylinder sleeve or tube with the valves after loosening the cylinder head screws.

The internal combustion engine includes valve guides in each of the cylinder heads 1 for effecting guiding of said valves 2 therein; each of the valve guides comprises two coaxially arranged circular cylindrical sleeves 26, 27 of different diameters, and a horizontal engagement and sealing disc 25 which interconnects the sleeves 26, 27; each valve is provided with a valve disc 24; and that surface of the housing 12 for the valve actuating devices 16 is provided with opening which allow a respective valve to pass therethrough.

In FIG. 2, the housing 7' is unitary or integral with the intake pipe 5', and the housing 12' is unitary or integral with the cylinder 1'. In this situation, a slot or elongated hole is provided for the nut and bolt connection 15' in order to compensate for the different structural heights. A seal 30 is furthermore provided between each housing; separate covers or tops 31 and 32 are also provided. A standard valve guide 33 can now be used in place of the valve guide of FIG. 1, since a seal is no longer necessary.

Furthermore, the bearing blocks or brackets 34 are made integrally or in one piece with the intake pipe 5'. This requires a considerably greater mounting diameter for the camshaft 8', since the latter is now pushed axially through the bearing blocks or brackets 34. The bearing blocks or brackets 34 can also be divided, with the lower part being made integrally with the intake pipe 5', and the cover is screwed on.

Naturally, it is also possible to undertake a combination of the inventive variations illustrated in FIGS. 1 and 2, for example constructing the housing 12, 12' separate from the cylinder head 1, 1', and constructing the housing 7, 7' integrally with the intake pipe 5, 5'.

The present invention is, of course, in no way restricted to the specific disclosure of the specification and drawings, but also encompasses any modifications within the scope of the appended claims.

What is claimed is:

1. An air-cooled, multicylinder internal combustion engine having an overhead camshaft used for all cylinders therewith and having individual cylinder heads independently thereof for all cylinders therewith, each of which is provided with valves guided therein, and with air inlet passages respectively leading to said valves, said engine comprising:

an intake pipe as a manifold flanged to said cylinder heads and provided with individual connecting passages respectively leading to said inlet passages, said intake pipe itself being the carrier and mounting element directly therewith for said camshaft independent of any individual cylinder head alignment and connection; and transfer elements in the form of valve actuating devices respectively operatively associated with said camshaft and said valves for effecting actuation of the latter.

2. An internal combustion engine according to claim 1, in which said camshaft mounted on said intake pipe is provided with cams, and in which said transfer elements include rocker arms which are in direct operative connection with said cams.

3. An internal combustion engine according to claim 1, which includes a U-shaped housing also mounted directly on said intake pipe for receiving said camshaft provided with an extension over each of said cylinder heads for receiving said valve actuating devices engaging therewith.

4. An internal combustion engine according to claim 1, which includes separate pieces of housings respectively fastened to said intake pipe and said cylinder heads for said overhead camshaft and said valve actuating devices respectively.

5. An internal combustion engine according to claim 1, which includes at least one housing for accommodating said overhead camshaft and said valve actuating devices, and a single cover for said at least one housing.

6. An internal combustion engine according to claim 1, which includes bearing sections, fastening screws for the latter relative to said intake pipe, and a camshaft housing which is fastened to said intake pipe via said fastening screws.

7. An internal combustion engine according to claim 4, which includes spacers inserted between said separate housing for said valve actuating devices and each of said cylinder heads, for equalizing the height relationship thereof.

8. An internal combustion engine according to claim 4, which includes valve guides in each of said individual cylinder heads for effecting guiding of said valves therein, each of said valve guides comprising two coaxially arranged circular cylindrical sleeves of different diameters, and a horizontal engagement and sealing disc which interconnects said sleeves; in which each valve is provided with a valve disc; and in which that surface of said housing for said valve actuating devices is provided with openings which allow a respective valve to pass therethrough.

9. An internal combustion engine according to claim 1, which includes housing means for accommodating said overhead camshaft on said intake pipe and said valve actuating devices, said housing means being respectively integrally cast with said intake pipe and said cylinder heads.

* * * * *